US006698612B1

(12) United States Patent
Krasky et al.

(10) Patent No.: US 6,698,612 B1
(45) Date of Patent: Mar. 2, 2004

(54) WOVEN PLASTIC CONTAINER FOR PLANTS AND METHOD OF MAKING

(76) Inventors: Roy W. Krasky, 24231 Township Rd. 1173, Coshocton, OH (US) 43812; Ray B. Coblentz, 5452 C.R. 201, Millersburg, OH (US) 49654

( * ) Notice: Subject to any disclaimer, the term of this patent is extended or adjusted under 35 U.S.C. 154(b) by 198 days.

(21) Appl. No.: 09/610,203

(22) Filed: Jul. 2, 2000

(51) Int. Cl.[7] ..... B65D 19/00

(52) U.S. Cl. ..... 220/493; 220/494; 220/668; 206/457

(58) Field of Search ..... 220/493, 494, 220/668; 217/122; 206/457

(56) References Cited

U.S. PATENT DOCUMENTS

| | | | | | |
|---|---|---|---|---|---|
| 475,973 | A | * | 5/1892 | Beers | 220/493 X |
| 580,947 | A | * | 4/1897 | Mallett | 220/668 |
| 1,950,921 | A | * | 3/1934 | Gray et al. | 220/493 |
| 2,067,753 | A | * | 1/1937 | Cooper et al. | |
| 2,548,966 | A | * | 4/1951 | Gilmore | 220/493 X |
| 2,962,273 | A | * | 11/1960 | Moore | 220/493 |
| 3,563,292 | A | * | 2/1971 | Gordon et al. | |
| 5,947,313 | A | * | 9/1999 | Kern et al. | 220/668 X |

* cited by examiner

*Primary Examiner*—Joseph Man-Fu Moy
(74) *Attorney, Agent, or Firm*—Kremblas, Foster, Phillips & Pollick

(57) ABSTRACT

A woven plastic container for plants is provided having an outside bottom band, a plurality of splints, an inside top band, a plurality of weave strips, and an outside top band. The outside bottom band has an interior surface and an exterior surface. Each splint is spaced apart a predetermined distance from each directly adjacent splint, and each splint is in contact with the outside bottom band interior surface. The inside top band has an interior surface and an exterior surface, with the exterior surface being in contact with each of the splints. Each of the weave strips is woven through the splints, and each of the weave strips is spaced at predetermined distances from each directly adjacent weave strip. The outside top band has an interior surface and an exterior surface, and with the interior surface being in contact with each of the splints. In one embodiment of the invention the container has a base, with the base being attached to the splints and the outside bottom band. In another embodiment of the invention, the container includes an inside bottom band, with the inside bottom band being attached to the splints and the outside bottom band. The plastic composition of the container preferably includes a blend of high density and low density polyethylene, a coloring agent, and a blowing agent. The coloring agent which typically is plastic pellets may contain an ultraviolet protectant. A method of manufacturing a woven plastic container for plants is also disclosed.

20 Claims, 2 Drawing Sheets

WOVEN PLASTIC CONTAINER FOR PLANTS AND METHOD OF MAKING

FIELD OF THE INVENTION

The present invention relates generally to a woven plastic container, and more particularly, to a woven plastic container which resembles a wooden basket and which container is used in conjunction with the display of plants.

BACKGROUND OF THE INVENTION

This invention is directed to the providing of a container, which container resembles one woven from wood, and more particularly to such containers as are used outdoors to display plants. Woven wood objects commonly referred to as baskets have been around for thousands of years. Examples of ancient baskets have been found in numerous cultures on almost all of the continents. Baskets have been used to transport items as well as hold them for decorative purposes.

Today, in the United States alone, sales of hand-made wooden baskets flourish. Indeed, several well known wooden basket companies experience substantial sales of wooden, woven-products in a wide variety of shapes and sizes. Oftentimes, these wooden woven items are used for decorative purposes, instead of merely functionally serving as a container. Furthermore, decorating with baskets is no longer limited to the interior of a residence. Increasingly, wooden baskets or other woven decorative items similar to baskets, known as sleeves, are appearing in landscaping applications. Such applications include serving as planters, hanging baskets, and other numerous uses.

One problem inherent in the use of wood as a raw material for the manufacture of baskets is its tendency to split or splinter over time. This characteristic is exacerberated in outdoors conditions where the containers are typically subjected to precipitation, variability in temperature, and exposure to the sun's ultraviolet rays. Consequently, over time containers made from wood tend to structurally deteriorate.

In addition to the aforementioned structural deterioration, exposure of wooden containers to the elements compromises the aesthetic quality associated with these containers when new. One readily ascertainable way in which the aesthetic quality of these containers is diminished with the passage of time is a loss of color. Containers which when new are honey or cedar colored or imbued with a slight reddish tint tend to become gray or at best a faded brown. One other problem with wooden woven containers is that the water to which they are subjected during storms or normal watering coupled with humidity and proximity to vegetation can cause these containers to mildew. The presence of unsightly black spots on wooden woven containers detracts from their appearance. Therefore, care must be taken to regularly attend to mildew removal through the application of yet more water and an appropriate cleanser, both of which may further dry out the container's wood.

Due to the costs historically associated with woven wood baskets, the effective built-in obsolescence associated with the outdoors use of wooden baskets permits the problem to be addressed somewhat by the buying of a new container. Of course, such a purchase assumes that the same type of container will still be available, which assumption is not always correct. Furthermore, woven wooden objects have become increasingly collectible. In fact, tens of thousands of individuals avidly collect wooden basket-like products. Therefore, maintaining a basket in an attractive condition may make business sense as well.

It is thus apparent that the need exists for a woven container for the displaying of plants, which woven container is durable, and which container remains aesthetically attractive with the passage of time.

SUMMARY OF THE INVENTION

In accordance with this invention a woven plastic container for plants is provided. The container may take the form of one several embodiments, each similar to woven wooden containers already in existence, each of such woven wooden containers suffering from the deficiencies or undesirable characteristics noted above. In their simplest form, each of the woven plastic containers has an outside bottom band, with the outside bottom band having an interior surface and an exterior surface, a plurality of splints, each splint spaced apart a predetermined distance from each directly adjacent splint, each splint being in contact with the outside bottom band interior surface, an inside top band, with the inside top band having an interior surface and an exterior surface, with the exterior surface being in contact with each of the splints, a plurality of weave strips, each of the weave strips being woven through the splints, each of the weave strips being spaced at predetermined distances from each directly adjacent weave strip, and an outside top band, with the outside top band having an interior surface and an exterior surface, and with the interior surface being in contact with each of the splints.

Preferably, each splint is secured to the outside bottom band. Similarly, each splint is secured to the outside top band. In one embodiment of the invention the container has a base, with the base being attached to the splints and the outside bottom band. In another embodiment of the invention, the container includes an inside bottom band, with the inside bottom band being attached to the splints and the outside bottom band.

Preferably, each of the weave strips overlap a plurality of splints. More preferably, each of the weave strips overlap three splints. In one embodiment of the invention, the container has at least one handle, with the handle being in direct contact with and secured to the outside top band.

The woven plastic container made in accordance with this invention is fabricated from a plastic composition comprising polyethylene, a blowing agent, and a coloring agent. Preferably the plastic composition comprises a blend of high density polyethylene and low density polyethylene. More preferably the plastic composition includes recycled or scrap plastic. Additionally, each of the outside bottom band, splints, inside top band, weave strips, and outside top band normally has one side which is rougher than the other. Also, an ultraviolet protectant may be a part of the plastic composition as an ingredient in the coloring agent which is typically colored pellets.

There is also disclosed a method of manufacturing a woven plastic container comprising the steps of forming an outside bottom band, with the outside bottom band having an interior surface and an exterior surface, arranging a plurality of splints, each splint being put in contact with the outside bottom band interior surface, each splint spaced apart a predetermined distance from each directly adjacent splint, forming an inside top band, with the inside top band having an interior surface and an exterior surface, with the exterior surface being put in contact with each of the splints, positioning a plurality of weave strips, each of the weave strips being woven through the splints, each of the weave strips being spaced at predetermined distances from each directly adjacent weave strip, and forming an outside top band, with the outside top band having an interior surface and an exterior surface, and with the interior surface being put in contact with each of the splints.

The method associated with making one embodiment of the invention includes the additional step of having a base attached to the splints and to the interior surface of the outside bottom band. In the making of another embodiment of the invention, there is the additional step of having an inside bottom band attached to the splints and to the interior surface of the outside bottom band.

The method may include the additional steps of selecting a plastic composition comprising at least one type of plastic, a coloring agent and a blowing agent, and extruding the plastic composition into strips. The extruded strip may be cuts into strips of a predetermined length for ease of assembly as splints, or coiled into a roll. Preferably the plastic composition includes polyethylene, and more preferably a blend of high density polyethylene and low density polyethylene. An ultraviolet protectant may also be included in the plastic composition as an ingredient in the coloring agent which is typically colored pellets.

The method may include the additional step of having the plastic composition following extrusion passes into a water bath where the upper surface of the extruded plastic strip comes into contact with at least one stationary object which causes the plastic strip to have one surface rougher than the other, and with the extruded plastic being extruded in a plurality of different width strips, from the different width strips each of the outside bottom bands, splints, inside top bands, weave strips, and outside top bands are selected. The method may also include the step of having the plastic composition following extrusion pass into a water bath where the upper surface of the extruded plastic strip comes into contact at least four separate times with a stationary object which causes the plastic strip to have one surface rougher than the other.

The primary objective of this invention is to provide a woven plastic container for plants which is durable and remains aesthetically pleasing with the passage of time.

Another objective of this invention is to provide a woven plastic container for plants which is of relatively economical construction and relatively easy to fabricate.

Other objects and advantages of the invention will be apparent from the following description, the accompanying drawings, and the appended claims.

DETAILED DESCRIPTION OF THE DRAWINGS

Figure 1:
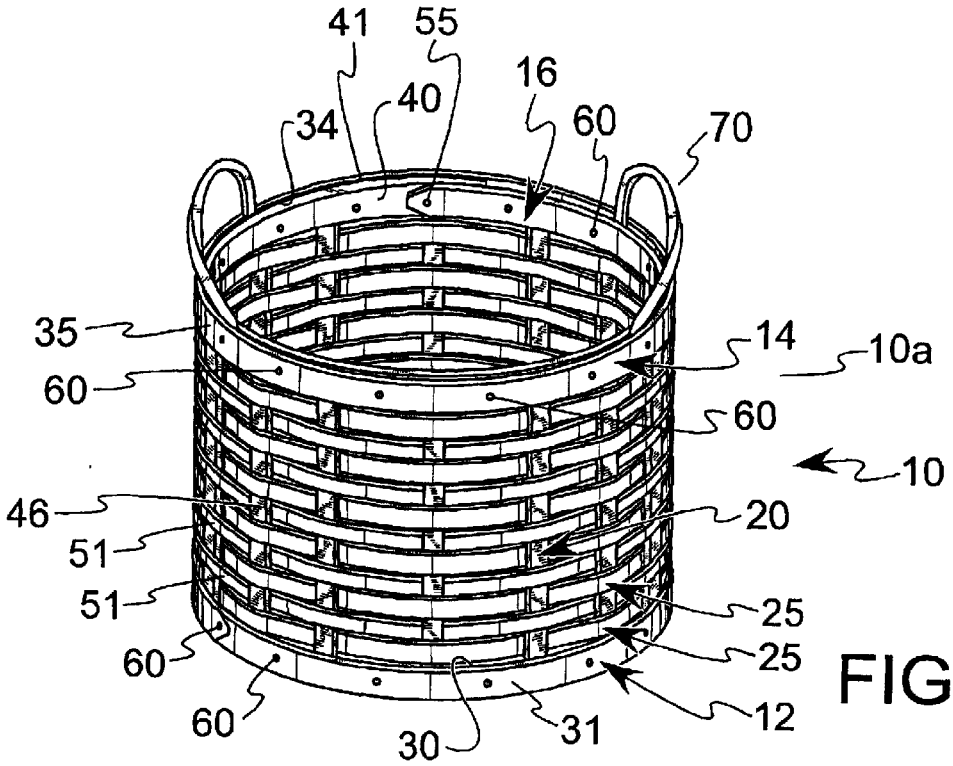
FIG. 1 is a perspective view of one embodiment of a woven plastic container made in accordance with the present invention.

Having reference to the drawings, attention is directed first to FIG. 1 which discloses a woven plastic container for plants, with the container being of one embodiment designated generally by the numeral 10. As will be appreciated by a comparison of FIG. 1, with FIG. 2 and FIG. 3, various embodiments of the woven plastic container of this invention can be manufactured. Characteristic of each such container is a wood-like appearance, although the containers are formed of colored, extruded plastic strips. Additionally, most of the embodiments of the containers might more properly be referred to by the term "sleeve" since they do not have a traditional bottom. These embodiments of the invention effectively have an opening formed completely through the container from top to bottom. However, some embodiments of the invention do include the traditional container bottom, so as to more resemble a basket.

The containers may be fabricated in a plurality of diameters, such as 8", 10", 12", 16", 20" and 27", each of these numbers corresponding to the diameter at the top of the container. While the side walls could be perpendicular to the top and bottom of the container, traditionally, baskets and sleeves taper slightly inwardly from top to bottom. Additionally, the plastic strips from which the container of this invention is manufactured can be colored or dyed to resemble natural wood, such as cedar, or shades such as blue, red, or green, although it is possible that other colors could be used. Furthermore, the baskets can be woven from a single colored plastic or from a plurality of colors in numerous combinations.

The plastic composition associated with this invention preferably includes in addition to a plastic, a blowing agent, and a coloring agent or agents to make the desired end color. It is anticipated that the type of plastic chosen for this basket will be polyethylene, and more preferably a blend of high density polyethylene (HDPE) and low density polyethylene (LDPE), and that specifically the plastic composition will include recycled or scrap plastic.

A common source of HDPE is recycled plastic milk bottles, although the source of plastic used in the invention thus far has been industrial scrap plastic from vial and cap manufacturers. The coloring agent may take the form of color pellets, such as the color concentrate sold by General Color, with the specific amount in comparison with the amount of polyethylene depending on the tint desired. Blowing agents are well known in the art of plastic extrusion. The specific blowing agent which is a component of the preferred embodiment of the invention is Leba-83 sold by Phoenix Color. The amount added depends on the specific final texture desired.

Figure 2:
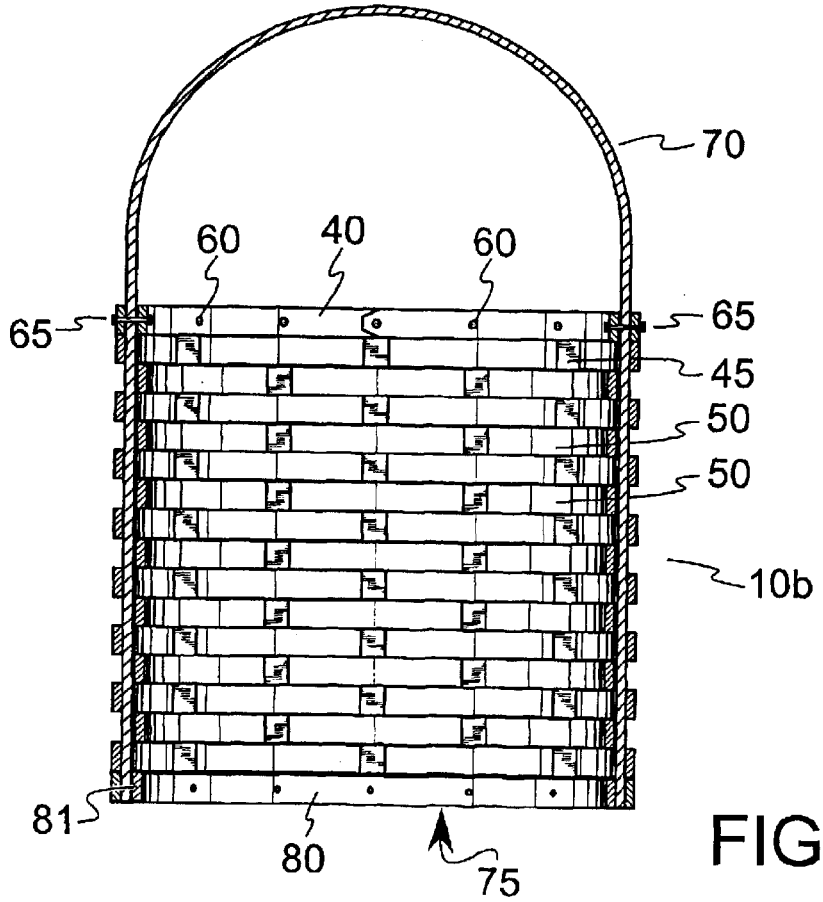
FIG. 2 is a vertical sectional view of another woven plastic container taken along a line similar to line 2—2 of FIG. 1.
Figure 3:
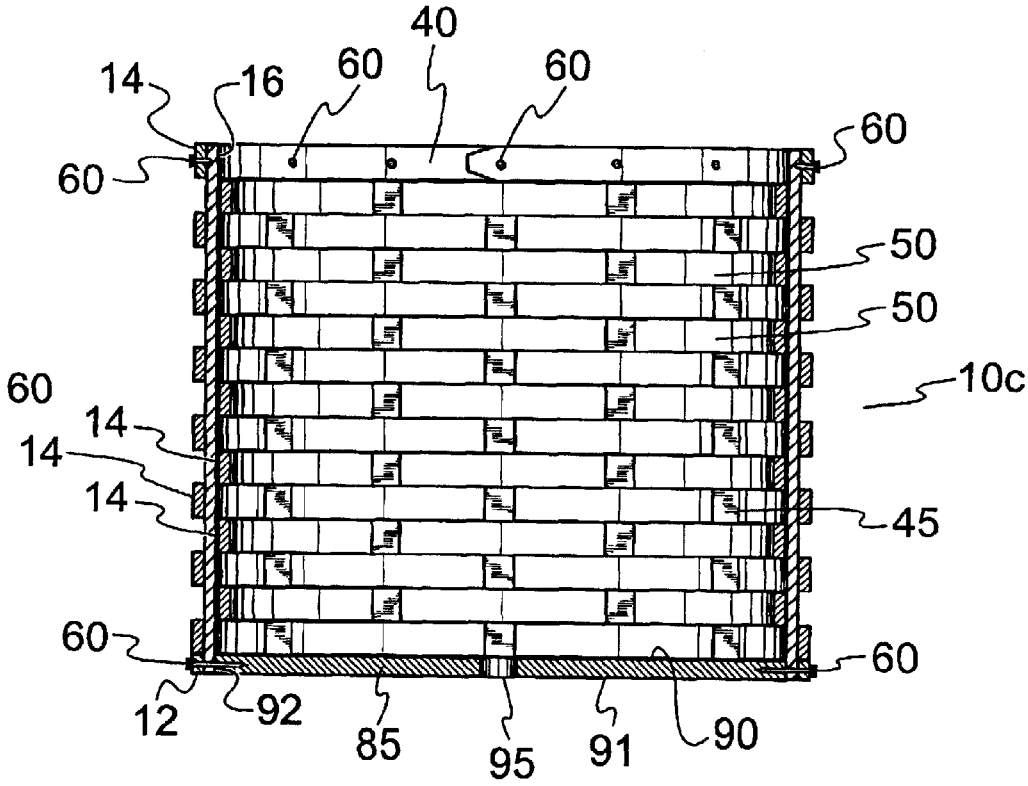
FIG. 3 is a vertical sectional view of yet another woven plastic container taken along a line similar to line 2—2 of FIG. 1.

Turning now to a discussion of the containers shown in FIGS. 1, 2, and 3, each of which figure discloses a slightly different embodiment of a container made in accordance with this invention, it will be appreciated that container 10*a* shown in FIG. 1 has an outside bottom band 12, an outside top band 14, and an inside top band 16. The top bands are preferably parallel to the bottom band with the inside top band 16 placed centrally of the outside top band 14. A plurality of splints 20 extend upwardly from beneath the outside bottom band to their terminus between the outside top band 14 and inside top band 16. Finally, it will be appreciated that a plurality of weave strips 25 are woven around the splints 20 in a generally horizontal direction such that they are parallel to the outside bottom band 12.

The outside bottom 12 is formed having an outside bottom band inner surface 30 with this interior surface. 30 being that which is in adjacent the bottom of splints 20. The outside bottom band 12 also has an outer surface 31 with this exterior surface 31 being visible on the outside of the basket.

Similarly, the outside top band 14 has an outside top band inner surface 34 and outer surface 35. The interior surface 40 is adjacent the top of splints 20, while the exterior surface 35 is visible on the outside of the container. The inside top band 16 also has an inner surface 40 and outer surface 41. The exterior surface 41 is adjacent the top of splints 20 while the interior surface faces towards the center of the container.

Each splint 20 also has an inner surface 45 and an outer surface 46. The interior surfaces are visible when looking inside the container and the exterior surfaces 46 are visible when looking at the outside of the container. This is also the case with weave strips 25 which have an inner surface 50 and an outer surface 51 with the interior surface 50 being visible on the inside of the container and the exterior surface 51 being visible on the outside of the container.

In general, the structure of FIGS. 1 and 2 is identical, with the exception of the type of handle 70. In FIG. 1, the container 10*a* has two handles on opposite sides of the container, while in FIG. 2, container 10*b* has a single arching handle extending from one side of the container to the other. With respect to the handle shown in FIG. 1, the ends of the handle terminate between the interior surface of the outside top band and the exterior surface of the inside top band. With respect to the handle shown in FIG. 2, it is secured to the container adjacent outer surface 35 of the outside top band.

In comparing FIGS. 2 and 3, it will be noted that there are two main distinctions. First, container 10*c* has no handle. Second, container 10*b* as well as 10*a* has an inside bottom band 75 having an inner surface 80 and an outer surface 81, which interior surface. 80 is visible from the inside of the container and which exterior surface 81 is adjacent splints 20. Meanwhile, in the embodiment shown as 10*c*, a base 85 is positioned centrally of the side walls of the container formed by the splints and weave strips 20 and 25, respectively. The base has a top surface 90 and a bottom surface 91 in addition to having a side wall 92 which is adjacent the splints, and at least one drain hole 95 which extends completely through base 85 from its top surface to its bottom surface. In the preferred embodiment of the invention, the base is disk-shaped, although it could be formed from intersecting rods.

In actual manufacture, each of the bands is formed separately and secured to itself by a first fastener 55 as can best be seen in FIG. 1. Preferably this fastener can be very small such as a staple. It will also be appreciated that a second type of fastener 60 is also utilized, with this fastener preferably being larger than first fastener 55. In the preferred embodiment of the invention, the heads on each of the second type of fasteners 60 resemble the head of a nail, although the end of the fastener is relatively smooth or at least fairly contiguous with the inner surface of the bands. This can be the consequence of having the tip of the nail bent during the forming process through the use of equipment commonly known in the art of basket making. Finally, as can be appreciated from FIG. 2, a third type of fastener 65 may be utilized, with this type of fastener being more of a rivet-type so as to enable the container to swing relative to the handle. In the preferred embodiment of the invention each of the fasteners is copper.

In actual use, the container of this invention is formed by selecting a plastic composition comprising at least one type of plastic, a coloring agent and a blowing agent, and extruding the plastic composition into strips. In the preferred embodiment of the invention the plastic composition includes an ultraviolet protectant in the coloring agent which is typically colored pellets. Preferably the plastic composition includes polyethylene, and more preferably a blend of high density polyethylene and low density polyethylene. In the preferred embodiment of the invention the ratio of high density polyethylene to low density polyethylene is 60:40.

The strips vary in width depending on the type of container to be manufactured, with their widths being ½", ¾", 1", or 1¼". It is by cutting such extruded strips that the outside bottom bands, inside bottom bands, splints, inside top bands, weave strips, and outside top bands are made. Typically, when a container is manufactured, the splints, and top and bottom bands are the same width, with that width being greater than the width of the weave strips. In the smaller diameter containers, strips having widths of ½" and 1" normally are used, while in the larger sizes strips having widths of 1" and 1¼" normally are used. Normally, the smaller width strips are used for weave strips or that which corresponds thereto, while the wider strips are used for the top and bottom bands and for the splints. Strip widths of ¾" have been used in containers other than sleeves and baskets. Examples of other containers which could be made using the disclosed invention include trashcans, window boxes, mailboxes, and birdhouses.

The plastic composition is formed by use of a mixing system, such as a Plasticolor 2000 mixing system having a 50 rpm auger speed. After extrusion and passage through a diehead, in the preferred embodiment of the invention, the plastic composition passes into a water bath in an 8" square trough where the upper surface of the extruded plastic strip comes into contact with at least one stationary object in the form of a plate or probe. The contact keeps the hot plastic extrudate in the water bath to assist in cooling. The presence of the plates also may have something to do with the plastic strip having one surface rougher than the other, as the top surface is left slightly smoother. More preferably, the upper surface of the extruded plastic strip comes into contact at least four separate times with a stationary object with this contact causing the plastic strip to have one. surface rougher than the other. As the extruded strip exits the water bath, it passes over a rubber or flexible plastic strip which helps to remove water from the bottom of the strip. Similarly, air is blown across the top of the strip as it exits the water bath to help remove water from the top of the strip. To help the extrudate move through the water bath, a conventional puller is used of the type well known in the art. Finally as the strip leaves the water bath it is either cut using a conventional cutting machine or coiled using a conventional coiling system. One coil of ½" width plastic can have 7000 feet of plastic.

In those containers which have a closed bottom due to the presence of base 85, the method of manufacturing a woven plastic container first includes the step of forming an outside bottom band including fastening it to itself. Then a plurality of splints are arranged between the base and the outside bottom band, each splint being put in contact with the base and the outside bottom band interior surface and spaced apart a predetermined distance from each directly adjacent splint, whereupon the outside bottom band is fastened to splints and the base at the same time by an appropriate fastener. Then an inside top band is formed with the exterior surface being put in contact with each of the splints. The weave strips are then positioned, each of them being woven through the splints and being spaced at predetermined distances from each directly adjacent weave strip. Then the outside top band is formed with the interior surface thereof being put in contact with each of the splints, and the outside top band fastened to the splints.

In those containers which have an open bottom due to the presence of inside bottom band 75, the method of manufacturing a woven plastic container first includes the step of forming an inside bottom band attached to itself by suitable first fasteners. The inside top band is then formed. Then, the outside bottom band is formed, and a plurality of splints are arranged therearound between it and the inside bottom band.

Each splint is in contact with the outside bottom band interior surface and the inside bottom band exterior surface, and each splint is spaced apart a predetermined distance from each directly adjacent splint. The outside bottom band, inside bottom band and splints are then secured to one another by appropriate fastening means. The weave strips are then woven through the splints, each of the weave strips being spaced at predetermined distances from each directly adjacent weave strip. Preferably each of the weaving strips overlaps three of the splints, but the number could be less.

While the form of apparatus and method of fabrication herein described constitutes a preferred embodiment of this invention, it is to be understood that the invention is not limited to this precise form of apparatus or method of fabrication and that changes may be made therein without departing from the scope of the invention which is defined in the appended claims.

What is claimed is:

1. A woven plastic container for plants, said woven container made of a plastic material characterized by said plastic material comprising polyethylene, a blowing agent, and a coloring agent, said woven plastic container comprising an outside bottom band, said outside bottom band having an interior surface and an exterior surface, a plurality of splints, each splint spaced apart a predetermined distance from each directly adjacent splint, each splint being in contact with said outside bottom band interior surface, an inside top band, said inside top band having an interior surface and an exterior surface, said exterior surface being in contact with each of said splints, a plurality of weave strips, said weave strips woven through said splints, said weave strips being spaced at predetermined distances from each directly adjacent weave strip, and an outside top band, said outside top band having an interior surface and an exterior surface, said interior surface being in contact with each of said splints.

2. The woven plastic container according to claim 1 wherein each splint is secured to said outside bottom band.

3. The woven plastic container according to claim 1 wherein each splint is secured to said outside top band.

4. The woven plastic container according to claim 1 which includes a base, said base being attached to said splints and said outside bottom band.

5. The woven plastic container according to claim 1 which includes an inside bottom band, said inside bottom band being attached to said splints and said outside bottom band.

6. The woven plastic container according to claim 1 wherein each of said weave strips overlap a plurality of splints.

7. The woven plastic container according to claim 1 wherein said plastic material is characterized by comprising an ultraviolet protectant.

8. The woven plastic container according to claim 1 wherein said plastic composition comprises a blend of high density polyethylene and low density polyethylene.

9. The woven plastic container according to claim 1 wherein said plastic composition includes recycled plastic.

10. The woven plastic container according to claim 1 wherein each of said outside bottom band, splints, inside top band, weave strips, and outside top band has one side which is rougher than the other.

11. The woven container according to claim 1 wherein said plastic material is textured to resemble wood.

12. The woven container according to claim 1 wherein said woven container comprises copper fasteners.

13. A method of manufacturing a woven container made of a plastic material characterized by the plastic material comprising polyethylene, a blowing agent, and a coloring agent comprising the steps of forming an outside bottom band, said outside bottom band having an interior surface and an exterior surface, arranging a plurality of splints, each splint being put in contact with said outside bottom band interior surface, each splint spaced apart a predetermined distance from each directly adjacent splint, forming an inside top band, said inside top band having an interior surface and an exterior surface, said exterior surface being put in contact with each of said splints, positioning a plurality of weave strips, said weave strips being woven through said splints, said weave strips being spaced at predetermined distances from each directly adjacent weave strip, and forming an outside top band, said outside top band having an interior surface and an exterior surface, said interior surface being put in contact with each of said splints.

14. The method according to claim 13 which includes the additional step of having a base attached to said splints and to the interior surface of said outside bottom band.

15. The method according to claim 13 which includes the additional step of having an inside bottom band attached to said splints and to the interior surface of said outside bottom band.

16. The method according to claim 13 which includes the additional steps of adding an ultaviolet protectant to said polyethylene, blowing agent, and coloring agent, and extruding said plastic material into strips.

17. The method according to claim 16 wherein said plastic material comprises a blend of high density polyethylene and low density polyethylene.

18. The method according to claim 16 wherein said plastic material following extrusion passes into a water bath wherein the upper surface of the extruded plastic strip comes into contact with at least one stationary object which causes said plastic strip to have one surface rougher than the other, said extruded plastic being extruded in a plurality of different width strips, from said different width strips each of said outside bottom bands, splints, inside top bands, weave strips, and outside top bands being selected.

19. The method according to claim 18 which includes the step of having the plastic material following extrusion pass into a water bath wherein the upper surface of the extruded plastic strip comes into contact at least four separate times with a stationary object which causes said plastic strip to have one surface rougher than the other.

20. A woven plastic container fabricated from a plastic material, said plastic material characterized by said plastic material comprising polyethylene, a blowing agent, a coloring agent, and ultraviolet protectant, said woven plastic container comprising a plurality of splints and a plurality of weave strips, each splint spaced apart a predetermined distance from each directly adjacent splint, said weave strips woven through said splints, said weave strips being spaced a predetermined distance from each directly adjacent weave strip, said splints and weave strips fabricated having one side textured to resemble wood.

* * * * *